US006099377A

United States Patent [19]

Pridemore

[11] Patent Number: 6,099,377

[45] Date of Patent: Aug. 8, 2000

[54] TOY ATTACHMENT FOR CHILD'S PLAY PEN

[76] Inventor: Jacqueline S. Pridemore, 2724 Peach Tree La., Irving, Tex. 75062

[21] Appl. No.: 09/048,532

[22] Filed: Mar. 26, 1998

[51] Int. Cl.[7] ..... A63H 33/00

[52] U.S. Cl. ..... 446/227; 5/658; 434/203

[58] Field of Search ..... 446/227; 434/173, 434/174, 175, 203, 204; 256/25; D6/331, 382; 5/93.1, 93.2, 100, 428, 429, 658, 907

[56] References Cited

U.S. PATENT DOCUMENTS

| | | | |
|---|---|---|---|
| D. 153,335 | 4/1949 | Brand | 5/93.1 |
| 246,729 | 9/1881 | Darne | 5/93.1 |
| 416,102 | 11/1889 | Hannahs | 5/100 |
| 1,661,283 | 3/1928 | Eckardt | 446/227 |
| 2,128,978 | 9/1938 | Akin | 5/93.1 |
| 2,471,762 | 5/1949 | Merrett | 446/227 |
| 2,625,694 | 1/1953 | Moss | 5/428 |
| 2,779,953 | 2/1957 | Thompson et al. | 5/428 |
| 3,643,924 | 2/1972 | Williams | 5/93.1 |
| 3,747,133 | 7/1973 | Hutt | 5/100 |
| 5,173,974 | 12/1992 | Proano et al. | 5/907 |
| 5,778,465 | 7/1998 | Myers | 5/93.1 |

FOREIGN PATENT DOCUMENTS

| | | | |
|---|---|---|---|
| 20620 | of 1904 | United Kingdom | 5/93.1 |
| 17890 | of 1913 | United Kingdom | 434/203 |

*Primary Examiner*—Robert A. Hafer
*Assistant Examiner*—Jeffrey D. Carlson

[57] ABSTRACT

A new toy attachment for child's playpen for attaching to a playpen to provide entertainment for a child. The inventive device includes a pair of side rails securable to an upper end of the opposed side walls of the playpen. Forward and rearward sections each have a pair of horizontal narrow rods secured therein. The narrow rods each have a plurality of beads and blocks slidably disposed thereon. A back rail extends between the back bars of the pair of side rails. The back rail is securable to an upper end of the rear wall of the playpen.

11 Claims, 2 Drawing Sheets

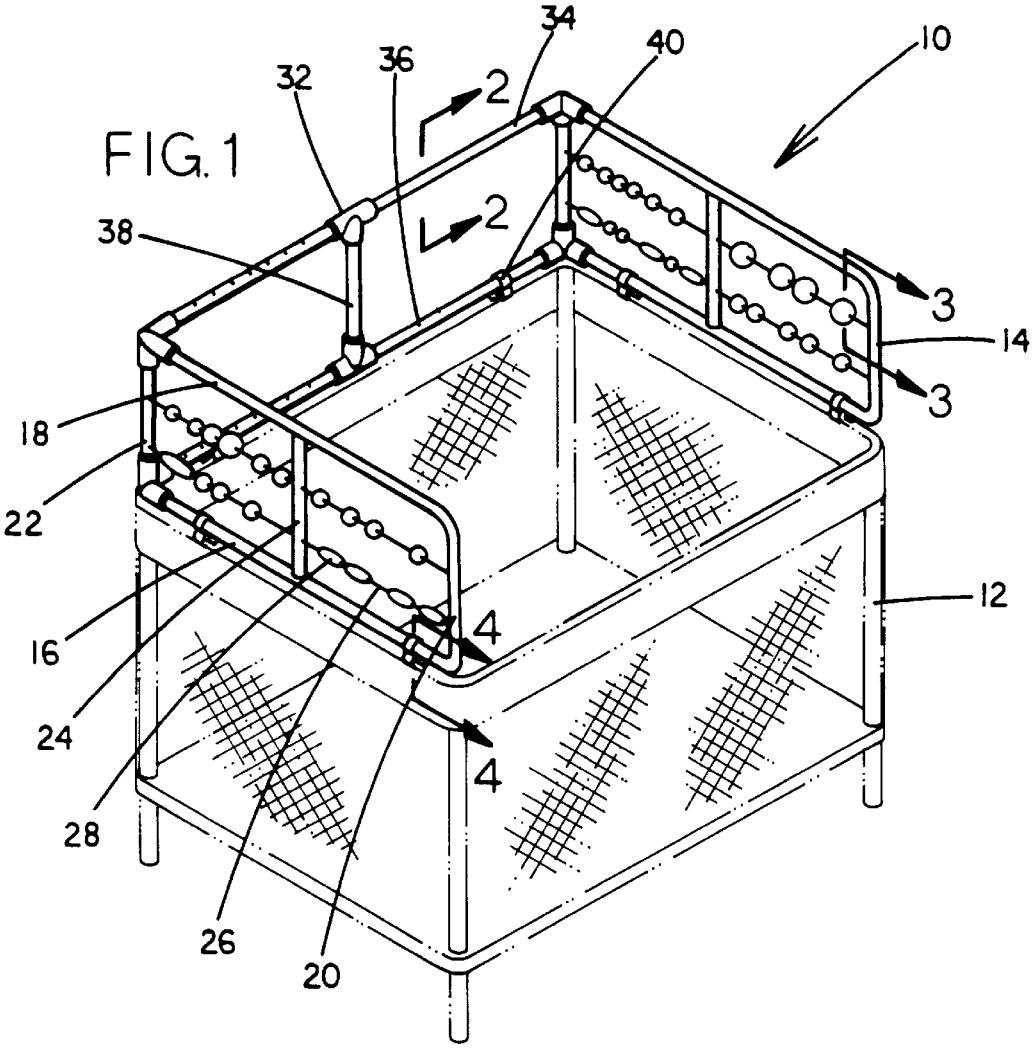
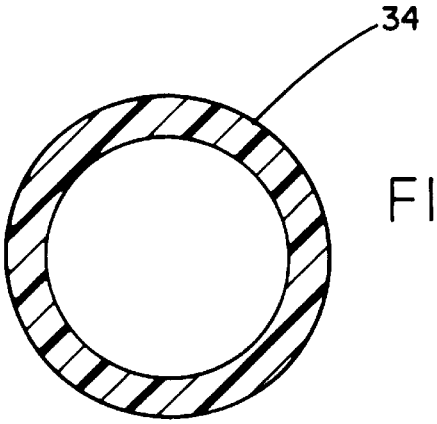
FIG. 2

FIG. 3
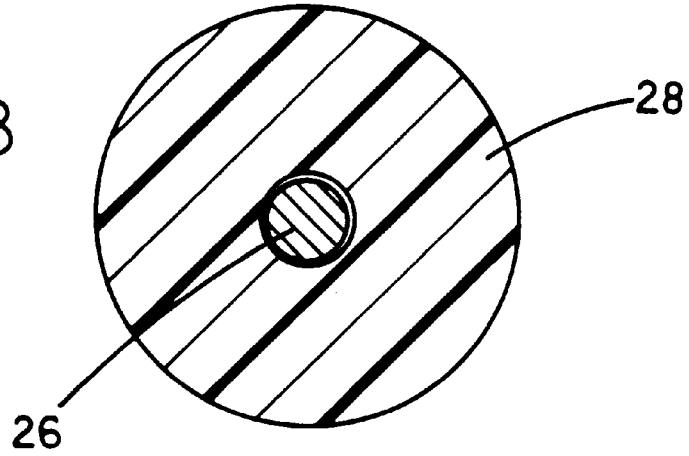
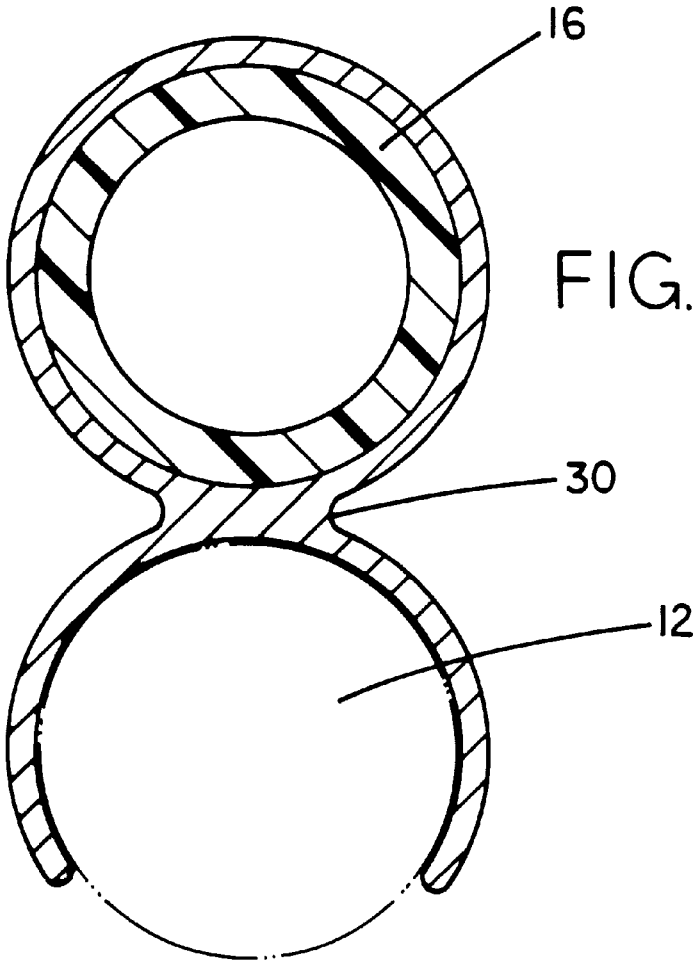
FIG. 4

TOY ATTACHMENT FOR CHILD'S PLAY PEN

BACKGROUND OF THE INVENTION

1. Field of the Invention

The present invention relates to children entertainment devices and more particularly pertains to a new toy attachment for child's playpen for attaching to a playpen to provide entertainment for a child.

2. Description of the Prior Art

The use of children entertainment devices is known in the prior art. More specifically, children entertainment devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art children entertainment devices include U.S. Pat. No. 5,425,546 to Gerber et al.; U.S. Pat. No. 4,573,654 to Nottingham; U.S. Pat. No. 4,968,279 to Smith; U.S. Pat. No. 3,304,651 to Deyerl; U.S. Pat. No. 1,258,651 to Broderick; Patent No. WO 97/17118 A1 to Bellows et al.; and Patent No. WO 96/22140 A1 to Kunnecke While these devices fulfill their respective, particular objectives and requirements, the aforementioned patents do not disclose a new toy attachment for child's playpen. The inventive device includes a pair of side rails securable to an upper end of the opposed side walls of the playpen. Forward and rearward sections each have a pair of horizontal narrow rods secured therein. The narrow rods each have a plurality of beads and blocks slidably disposed thereon. A back rail extends between the back bars of the pair of side rails. The back rail is securable to an upper end of the rear wall of the playpen.

In these respects, the toy attachment for child's playpen according to the present invention substantially departs from the conventional concepts and designs of the prior art, and in so doing provides an apparatus primarily developed for the purpose of attaching to a playpen to provide entertainment for a child.

SUMMARY OF THE INVENTION

In view of the foregoing disadvantages inherent in the known types of children entertainment devices now present in the prior art, the present invention provides a new toy attachment for child's playpen construction wherein the same can be utilized for attaching to a playpen to provide entertainment for a child.

The general purpose of the present invention, which will be described subsequently in greater detail, is to provide a new toy attachment for child's playpen apparatus and method which has many of the advantages of the children entertainment devices mentioned heretofore and many novel features that result in a new toy attachment for child's playpen which is not anticipated, rendered obvious, suggested, or even implied by any of the prior art children entertainment devices, either alone or in any combination thereof.

To attain this, the present invention generally comprises a child's playpen having a generally rectangular configuration. The playpen has an open upper end, a closed lower end, opposed front and rear walls, and opposed side walls. A pair of side rails are securable to an upper end of the opposed side walls of the playpen. Each of the side rails have a generally rectangular configuration. Each of the side rails have a lower bar, an upper bar, a front bar and a back bar. The lower bar and the upper bar have an intermediate bar extending therebetween. The intermediate bar divides each of the side rails into a forward section and a rearward section. The forward and rearward sections each have a pair of horizontal narrow rods secured therein. The narrow rods each have a plurality of beads and blocks slidably disposed thereon. Each lower bar has a pair of C-clamps extending downwardly therefrom. The C-shaped clamps secure the side rails to the upper ends of the opposed side walls of the playpen. A back rail extends between the back bars of the pair of side rails. The back rail is securable to an upper end of the rear wall of the playpen. The back rail has a generally rectangular configuration. The back rail includes an upper bar and a lower bar. An intermediate bar extends between the upper bar and the lower bar. The upper bar and the lower bar are comprised of a pair of telescoping members for adjusting a length of the back rail. The lower bar includes a pair of C-clamps extending downwardly therefrom. The C-shaped clamps secure the back rail to the upper end of the rear wall of the playpen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy attachment for child's playpen apparatus and method which has many of the advantages of the children entertainment devices mentioned heretofore and many novel features that result in a new toy attachment for child's playpen which is not anticipated, rendered obvious, suggested, or even implied by any of the prior art children entertainment devices, either alone or in any combination thereof.

It is another object of the present invention to provide a new toy attachment for child's playpen which may be easily and efficiently manufactured and marketed.

It is a further object of the present invention to provide a new toy attachment for child's playpen which is of a durable and reliable construction.

An even further object of the present invention is to provide a new toy attachment for child's playpen which is susceptible of a low cost of manufacture with regard to both materials and labor, and which accordingly is then susceptible of low prices of sale to the consuming public, thereby making such toy attachment for child's playpen economically available to the buying public.

Still yet another object of the present invention is to provide a new toy attachment for child's playpen which provides in the apparatuses and methods of the prior art some of the advantages thereof, while simultaneously overcoming some of the disadvantages normally associated therewith.

Still another object of the present invention is to provide a new toy attachment for child's playpen for attaching to a playpen to provide entertainment for a child.

Yet another object of the present invention is to provide a new toy attachment for child's playpen which includes a pair of side rails securable to an upper end of the opposed side walls of the playpen. Forward and rearward sections each have a pair of horizontal narrow rods secured therein. The narrow rods each have a plurality of beads and blocks slidably disposed thereon. A back rail extends between the back bars of the pair of side rails. The back rail is securable to an upper end of the rear wall of the playpen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new toy attachment for child's playpen according to the present invention.

FIG. 2 is a cross-sectional view of the present invention as taken along line 2—2 of FIG. 1.

FIG. 3 is a cross-sectional view of the present invention as taken along line 3—3 of FIG. 1.

FIG. 4 is a cross-sectional view of the present invention as taken along line 4—4 of FIG. 1.

DESCRIPTION OF THE PREFERRED EMBODIMENT

With reference now to the drawings, and in particular to FIGS. 1 through 4 thereof, a new toy attachment for child's playpen embodying the principles and concepts of the present invention and generally designated by the reference numeral 10 will be described.

As best illustrated in FIGS. 1 through 4, the toy attachment for child's playpen 10 comprises a child's playpen 12 having a generally rectangular configuration. The playpen 12 has an open upper end, a closed lower end, opposed front and rear walls, and opposed side walls.

A pair of side rails 14 are securable to an upper end of the opposed side walls of the playpen 12. Each of the side rails 14 have a generally rectangular configuration. Each of the side rails 14 have a lower bar 16, an upper bar 18, a front bar 20 and a back bar 22. The lower bar 16 and the upper bar 18 have an intermediate bar 24 extending therebetween. The intermediate bar 24 divides each of the side rails 14 into a forward section and a rearward section. The forward and rearward sections each have a pair of horizontal narrow rods 26 secured therein. The narrow rods 26 each have a plurality of beads and blocks 28 slidably disposed thereon. Each lower bar 16 has a pair of C-clamps 30 extending downwardly therefrom. The C-shaped clamps 30 secure the side rails 14 to the upper ends of the opposed side walls of the playpen 12.

A back rail 32 extends between the back bars 22 of the pair of side rails 14. The back rail 32 is securable to an upper end of the rear wall of the playpen 12. The back rail 32 has a generally rectangular configuration. The back rail 32 includes an upper bar 34 and a lower bar 36. An intermediate bar 38 extends between the upper bar 34 and the lower bar 36. The upper bar 34 and the lower bar 36 are comprised of a pair of telescoping members for adjusting a length of the back rail 32. The lower bar 36 includes a pair of C-clamps 40 extending downwardly therefrom. The C-shaped clamps 40 secure the back rail 32 to the upper end of the rear wall of the playpen 12. The back rail 32 does not feature built-in toys similar to the pair of side rails 14, but would be available to hang the child's own toys up in a safe manner.

In use, the present invention is an add-on accessory that would allow a parent to attach a variety of toys to entertain an infant or a toddler in a playpen 12. The pair of side rails 14 and the back rail 32 are joined by corner and T-shaped connectors.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy attachment for a child's playpen to provide entertainment for a child comprising:

a pair of side rails for securing to an upper end of opposed side walls of a playpen, forward and rearward sections each having a pair of horizontal narrow rods secured therein, the narrow rods each having a plurality of beads and blocks slidably disposed thereon;

each of the side rails comprising a continuous U-shaped member and a back bar extending between free ends of the U-shaped member, each U-shaped member having a lower bar, an upper bar, and a front bar; and a back rail extending between the back bars of the pair of side rails, the back rail being for securing to an upper end of a rear wall of the playpen;

wherein the lower bars of the side rails each have a pair of C-clamps extending downwardly therefrom, the C-shaped clamps being adapted for securing the side rails to the upper ends of the opposed side walls of the playpen; and wherein each of the C-clamps of the lower bars of the side rails have a generally figure 8 shaped transverse cross section taken perpendicular to the lower bar to which the clamp is attached.

2. The toy attachment for a child's playpen as set forth in claim 1 wherein the back rail includes an upper bar and a lower bar, an intermediate bar extending between the upper bar and the lower bar, the upper bar and the lower bar being comprised of a pair of telescoping members for adjusting a length of the back rail.

3. The toy attachment for a child's playpen as set forth in claim 1 wherein a lower bar of the back rail includes a pair of C-clamps extending downwardly therefrom, the C-shaped clamps being adapted for securing the back rail to the upper end of a rear wall of the playpen.

4. The toy attachment for a child's playpen as set forth in claim 1 wherein each of the C-clamps of the lower bars of the side rails has a circular portion and an open portion, the circular portions extending around the lower bars of the side and back rails, the open portions of each of the C-clamps being formed from a pair of opposed flaps, the opposed pairs of the flaps of the C-clamps being adapted for frictionally holding the upper end of the playpen therebetween.

5. The toy attachment for a child's playpen as set forth in claim 1 wherein a plurality of T-shaped connectors couple the back rail to the side rails.

6. The toy attachment for a child's playpen as set forth in claim 5 wherein each of the T-shaped connectors has three bar receiving portions being oriented at about 90 degree angles from each other.

7. The toy attachment for a child's playpen as set forth in claim 4 wherein pairs of flaps of each of the open portions of the C-clamps each follow an imaginary circle having a diameter substantially equal to the diameter of the circular portions of the C-clamps.

8. A toy attachment for a child's playpen for attaching to a playpen to provide entertainment for a child comprising:

a pair of side rails for securing to an upper end of opposed side walls of a playpen, forward and rearward sections each having a pair of horizontal narrow rods secured therein, the narrow rods each having a plurality of beads and blocks slidably disposed thereon;

each of the side rails comprising a continuous U-shaped member and a back bar extending between free ends of the U-shaped member, each U-shaped member having a lower bar, an upper bar, and a front bar; and a back rail extending between the back bars of the pair of side rails, the back rail being for securing to an upper end of a rear wall of the playpen;

wherein a lower bar of the back rail includes a pair of C-clamps extending downwardly therefrom, the C-shaped clamps being adapted for securing the back rail to the upper end of the rear wall of the playpen; and wherein each of the C-clamps of the lower bars of the side rails have a generally figure 8 shaped transverse cross section taken perpendicular to the lower bar to which the rail is attached.

9. The toy attachment for a child's playpen as set forth in claim 8 wherein each of the C-clamps of the lower bars of the side rails has a circular portion and an open portion, the circular portions extending around the lower bars of the side and back rails, the open portions of each of the C-clamps being formed from a pair of opposed flaps, the opposed pairs of the flaps of the C-clamps being adapted for frictionally holding the upper end of the playpen therebetween.

10. The toy attachment for a child's playpen as set forth in claim 9 wherein pairs of flaps of each of the open portions of the C-clamps each follow an imaginary circle having a diameter substantially equal to the diameter of the circular portions of the C-clamps.

11. A toy attachment for a child's playpen for attaching to a playpen to provide entertainment for a child comprising, in combination:

a child's playpen having a generally rectangular configuration, the playpen having an open upper end, a closed lower end, opposed front and rear walls, and opposed side walls;

a pair of side rails securable to an upper end of the opposed side walls of the playpen, each of the side rails having a generally rectangular configuration, each of the side rails having a continuous U-shaped member and a back bar extending between free ends of the U-shaped member, the U-shaped member having a lower bar, an upper bar, and a front bar, the lower bar and the upper bar having an intermediate bar extending therebetween, the intermediate bar dividing each of the side rails into a forward section and a rearward section, the forward and rearward sections each having a pair of horizontal narrow rods secured therein, the narrow rods each having a plurality of beads and blocks slidably disposed thereon, each lower bar having a pair of C-clamps extending downwardly therefrom, the C-clamps securing the side rails to the upper ends of the opposed side walls of the playpen;

a back rail extending between the back bars of the pair of side rails, the back rail being securable to an upper end of the rear wall of the playpen, the back rail having a generally rectangular configuration, the back rail including an upper bar and a lower bar, an intermediate bar extending between the upper bar and the lower bar, the upper bar and the lower bar being comprised of a pair of telescoping members for adjusting a length of the back rail, the lower bar including a pair of C-clamps extending downwardly therefrom, the C-shaped clamps securing the back rail to the upper end of the rear wall of the playpen;

wherein each of the C-clamps of the lower bars of the side and back rails have a generally figure 8 shaped transverse cross section taken perpendicular to the lower bar to which the clamp is attached;

each of the C-clamps having a circular portion and an open portion, the circular portions extending around the lower bars of the side and back rails;

the open portions of each of the C-clamps being formed from a pair of opposed flaps following an imaginary circle having a diameter substantially equal to the diameter of the circular portions of the C-clamps, the flaps being adapted for receiving the upper end of the upper end of the playpen, the upper end of the playpen being frictionally held between opposed pairs of the flaps of the C-clamps;

wherein a plurality of T-shaped connectors couple the back rail to the side rails; and each of the T-shaped connectors having three bar receiving portions being oriented at about 90 degree angles from each other.

* * * * *